US006601325B2

(12) United States Patent
Pearl et al.

(10) Patent No.: US 6,601,325 B2
(45) Date of Patent: Aug. 5, 2003

(54) FLEXIBLE INSULATING HEAD COVER FOR GARMENT PRESSES

(75) Inventors: Leo Pearl, Evanston, IL (US); Hector Hernandez, Chicago, IL (US)

(73) Assignee: Resillo Press Pad Company, Lincolnwood, IL (US)

( * ) Notice: Subject to any disclaimer, the term of this patent is extended or adjusted under 35 U.S.C. 154(b) by 0 days.

(21) Appl. No.: 10/021,967

(22) Filed: Dec. 13, 2001

(65) Prior Publication Data

US 2003/0110670 A1 Jun. 19, 2003

(51) Int. Cl.[7] ..... D06F 83/00
(52) U.S. Cl. ..... 38/66
(58) Field of Search ..... 38/66, 140, 1 R, 38/2, 3, 14, 16, 1 A, 36, 21, 1 C, 1 D, 4, 22, 1, 24; 150/154, 157, 165; 52/3

(56) References Cited

U.S. PATENT DOCUMENTS

| | | | | |
|---|---|---|---|---|
| 2,224,781 A | | 12/1940 | Chew | |
| 2,759,278 A | | 8/1956 | Fray | |
| 3,266,182 A | | 8/1966 | Cournoyer | |
| 3,321,852 A | * | 5/1967 | Anderson et al. | 38/66 |
| 3,471,955 A | | 10/1969 | Cohen | |
| 3,603,011 A | | 9/1971 | Cohen | |
| 3,775,880 A | | 12/1973 | Gilstrap | |
| 4,187,627 A | | 2/1980 | Cohen | |
| 5,014,453 A | * | 5/1991 | Gratsch | 38/36 |
| 5,755,049 A | | 5/1998 | Cohen et al. | |
| 5,819,446 A | | 10/1998 | Pearl et al. | |

OTHER PUBLICATIONS

Miraclean Finishing Equipment for Dry Cleaning & Laundry brochure, on best information and belief published before the present filing date.

Utility Hot Head Presses brochure, showing Air Operated Utility with Hot Head: Models AUH–42–C, AUH–45–C; Air Operated Utility With Reverse Buck and Hot Head: Models AURH–42–C, AURH–45–C, Cissell Manufacturing Company, Mar. 1990.

* cited by examiner

*Primary Examiner*—Ismael Izaguirre
(74) *Attorney, Agent, or Firm*—Greer, Burns & Crain, Ltd.

(57) ABSTRACT

An improved head cover for insulating a head of a garment press apparatus is disclosed having an inner layer of heat-resistant material configured to directly and contiguously cover a non-pressing upper surface of the head. An outer fabric covering of heat-resistant material is secured to and covers the inner layer to form a single piece. The head cover contains a cutout portion and at least one slot, for accommodating a portion of a supporting mechanism attached to the head and a portion of a steam inlet conduit, respectively. First and second portions of the head cover are detachable from one another for easy installation of the head cover on a variety of heads.

12 Claims, 5 Drawing Sheets

FLEXIBLE INSULATING HEAD COVER FOR GARMENT PRESSES

BACKGROUND OF THE INVENTION

The present invention relates generally to garment pressing equipment. More particularly, the invention relates to an improved, flexible insulating head cover that is lightweight, easily fitted onto a head of a garment press, and adjustable to various sizes of heads, while being capable of reducing heat loss and protecting an operator of the garment press apparatus from excessive escaping heat.

Commercial garment presses are traditionally used to dry clean, press, or finish laundry. In use, a garment to be cleaned or finished is placed on an upper surface of a typically elongated stationary supporting structure, commonly referred to as a "buck." An operator lowers a reciprocally movable, elongated upper member, commonly referred to as a "head," to press the head against the upper surface of the buck (or a buck pad) to press the garment. Live steam passes through steam inlet conduits running to and through the interior of the head, heated to an operating temperature approximating 300° F. The steam then exits through a lower surface of the head to treat the garment.

The lower surface of the head may be covered with a grid plate through which the steam passes. The grid plate is typically coated with polytetrafluoroethylene (PTFE), commonly sold under the name TEFLON, which is a registered trademark of E.I. duPont de Nemours & Company of Wilmington, Del.

One common problem linked with conventional garment presses is heat loss through the head, which results in inefficient energy use of the garment press in both the energy necessary to operate the steam press and the outside cooling systems needed to control the working environment for the operator. In addition, there is sufficient heat transfer from the interior of the head to the metal surface of the head to make the surface dangerous for an operator to touch due to the risk of skin burns.

To reduce heat loss and its inherent problems, thermal insulation covers have been developed and employed. One type of cover set is disclosed in U.S. Pat. No. 5,755,049 to Cohen et al., entitled "Thermal Insulation Cover Set for Steam and Laundry Press Apparatus," the entire disclosure of which is incorporated herein by reference. The cover set includes a head cover having two or more parts, each part having an insulation layer, a vapor barrier of moisture impervious foil or neoprene-coated fabric, and an innermost stabilizer member of a pliable sheet metal, such as aluminum, which is positioned contiguous to the upper surface of the head. The parts of the head cover surround a handle assembly and steam control valve, and are connected to each other by a set of tab fasteners, which connect with a corresponding set of tab fasteners attached to an underside of the head cover.

While the prior art head cover described above reduces heat loss and the risk of accidental skin burns, it contains a number of drawbacks not present in the instant invention. The requirement of a metallic stabilizer member and metallic vapor barrier reduces the flexibility of the prior art head cover, and forces the head cover to be bent to fit over the head. The prior art head cover is not as conformable to the head or other parts of the garment press as the instant invention, requires a tighter fit against the non-pressing surface of the head to secure the position of the cover, and is not as adjustable to various sizes of heads. Holes in the aluminum stabilizer barrier of the prior art head cover typically need to be covered by foil and batting. Due to the components required, the prior art head cover is relatively expensive to produce.

Accordingly, one object of the present invention is to provide an improved head cover for a garment press that is easy to install.

Another object of the present invention is to supply an improved head cover that is lightweight, flexible, and naturally conformable to a head of a garment press.

A further object of the present invention is to provide an improved head cover that can be easily adapted to a variety of press head sizes.

A still further object of the present invention is to furnish an improved head cover having a relatively small number of components, to be relatively inexpensive to manufacture.

SUMMARY OF THE INVENTION

The above objects are met or exceeded by the present improved head cover, which is designed to cover a non-pressing upper surface of a head of a garment press apparatus. The present improved head cover is more adaptable, less expensive to manufacture, lighter, and provides a more conforming fit than prior art head covers. The improved head cover is easily adaptable to various dimensions and configurations of a garment press apparatus even though the garment press apparatus may be supported by a support mechanism via an attached mounting flange, and even though the garment press apparatus may be connected to one or more steam inlet conduits for supplying steam to an interior of the head.

The present head cover includes an inner layer of heat-resistant material, such as heat-resistant synthetic felt fiber, having a first surface that directly and contiguously covers at least a portion of the upper surface of the head. An outer fabric covering of heat-resistant fabric, such as a heat-resistant synthetic fiber flannel, covers a second surface of the inner layer. As opposed to some prior art covers, metal stabilizers or barriers are not necessary in the inventive head cover. This makes the head cover flexible and relatively lightweight, and allows the head cover to conform to the upper surface of the head, as opposed to creating undesirable profiles throughout the head cover. The flexibility of the head cover allows it to be adaptable to various shapes and sizes of heads. The relatively small number of parts and manufacturing steps allows the head cover to be relatively inexpensive to manufacture, yet the cover provides sufficient insulation to conserve energy and protect an operator of the garment press apparatus from accidental burns.

The inner layer and outer fabric covering may be stitched together along a border seam, which is disposed about the boundary of the head cover. This boundary may include an outer periphery, which may be tucked into a lip holding a grid plate underneath the head. A number of spring fasteners used to secure the position of the grid plate may also be used to secure the position of the head cover. Accordingly, additional parts may not be needed. The head cover preferably is one integral piece, so that it is simple to install and so that the risk of detaching or misplacing a portion of the head cover is minimized or eliminated. However, the head cover may include two or more pieces that are removably fastened together.

A cutout portion of the head cover accommodates the mounting flange of the support mechanism attached to the head. The mounting flange may include a handle assembly, control valve, and/or steam inlet conduit. First and second sections around the cutout portion, which may partially overlap, are detachable from one another to create an opening for access to the cutout portion. This allows the head cover to be easily fitted around the mounting flange. The present head cover may also include one or more slots for accommodating one or more steam inlet conduits in a similar manner. The slots and cutout portion allow the inventive head cover to be easily installed while allowing it to securely remain in place.

DETAILED DESCRIPTION OF THE PREFERRED EMBODIMENT

Figure 1:
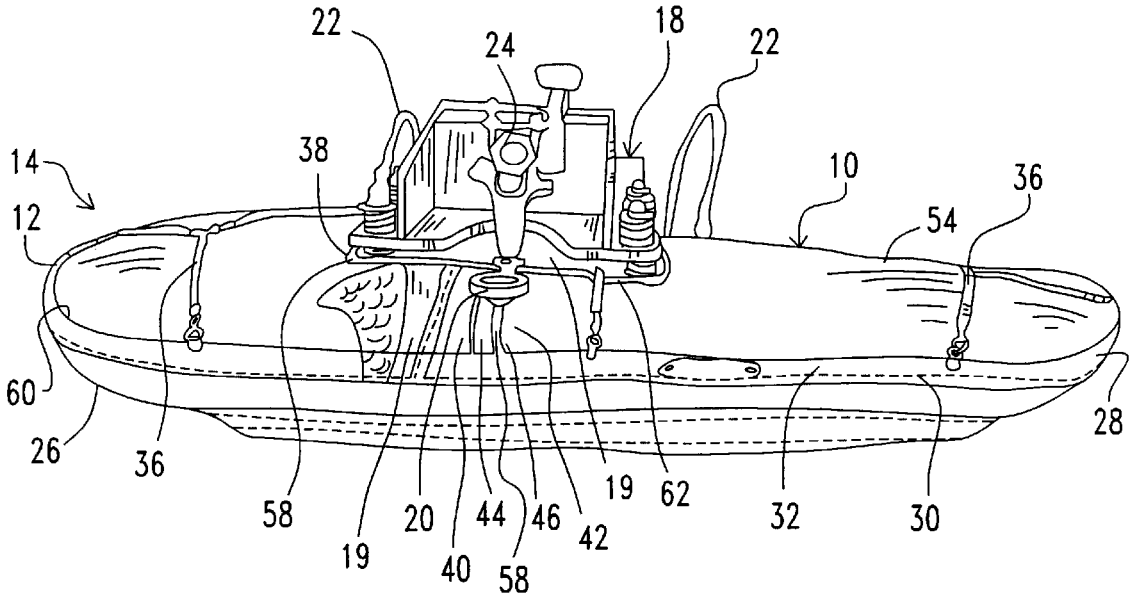
FIG. 1 is a front perspective view of a head cover fitted onto a head of a garment press apparatus, with the head in a closed position over a buck.
Figure 2:
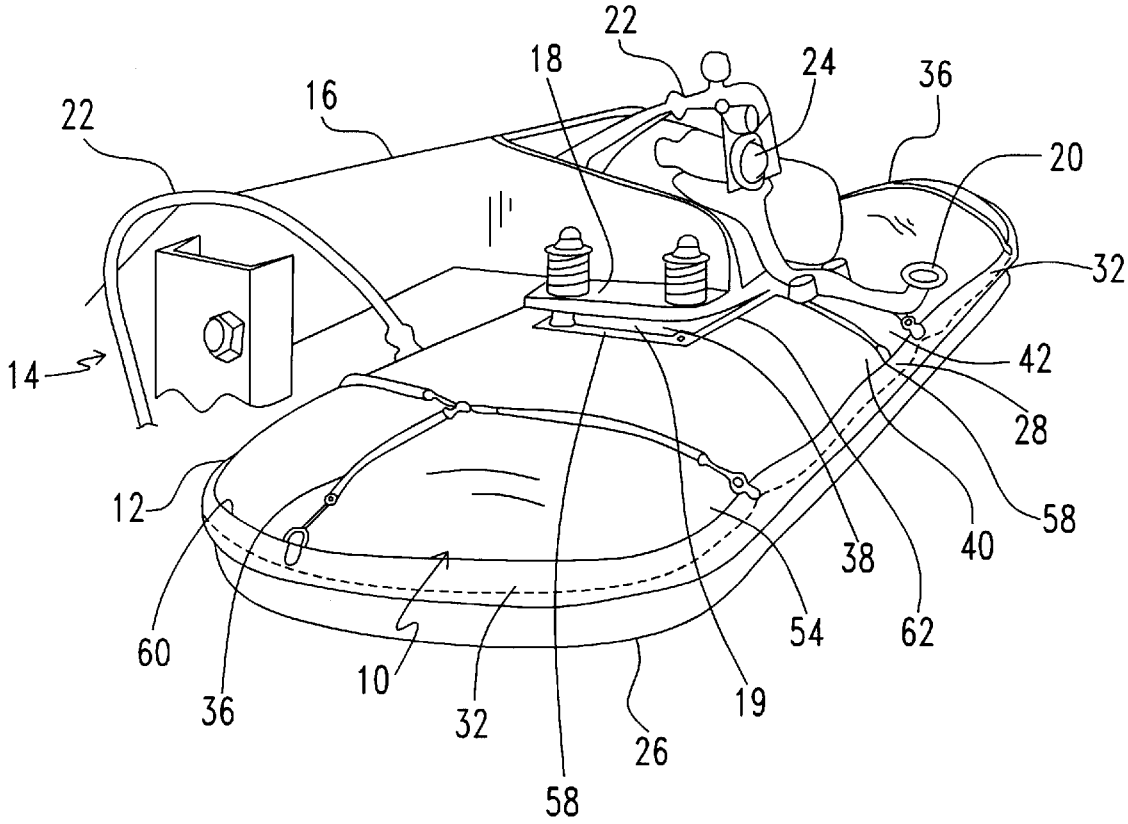
FIG. 2 is a perspective view of the head cover fitted onto the head of the garment press apparatus and around a support mechanism and steam inlet conduit.
Figure 3:
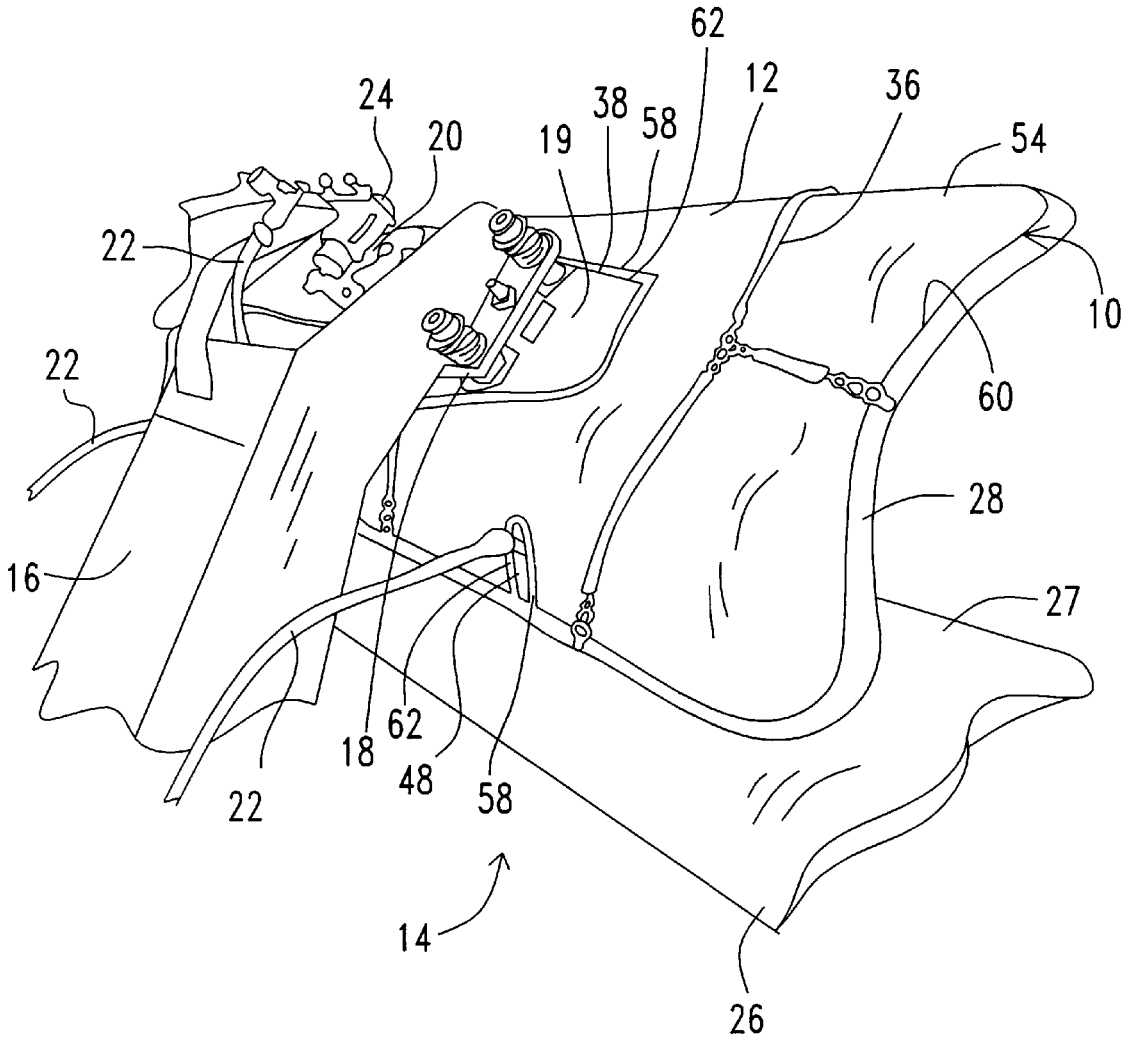
FIG. 3 is a perspective view of the head cover fitted onto an alternate head of a garment press apparatus with the head in a raised position.

Referring first to FIGS. 1–3, a head cover, generally designated 10, is disposed on a reciprocally movable, metal head 12 of a garment press apparatus 14. The head 12 is supported by a support mechanism 16 (shown more clearly in FIGS. 2 and 3) having a mounting flange 18 attached to an upper, non-pressing surface 19 of the head. The mounting flange 18 typically contains a handle assembly 20 for raising and lowering the head 12, one or more steam inlet conduits 22 for the introduction of steam into the interior of the head, and a control valve 24 for controlling the flow of steam. The head 12 is configured to be lowered onto a stationary buck 26 for pressing an upper surface 27 (best seen in FIG. 3) of the buck which supports a garment (not shown) to be pressed or cleaned.

A grid plate covers a lower, pressing portion (shown in FIG. 3) of the head 12, and contains a lip 28 about its periphery having a seam 30. The lip 28 is preferably made of a heat-resistant material such as NOMEX, which is a registered trademark of E.I. duPont de Nemours & Company of Wilmington, Del., and is a synthetic fiber of the nylon family of materials. An upper portion 32 of the lip 28 may extend slightly above the upper, non-pressing surface 19 of the head 12 about its periphery. The lip 28 is typically supported and held in position by a number of spring fasteners 36 which attach to the upper portion 32 of the lip at a number of points distributed about the lip for substantially even support. It is contemplated that the head cover 10 can be tucked into a space between the lip 28 and the upper, non-pressing surface 19 of the head 12.

A cutout portion 38 of the head cover 10 accommodates the mounting flange 18 containing the handle assembly 20, the steam inlet conduit 22, and the control valve 24. First and second removably attachable, partially overlapping flap portions 40, 42 of the head cover 10 are formed around a segment of the cutout portion 38 (best seen in FIG. 4). The partially overlapping flap portions 40, 42 are detachable from one another and separate and fold outwardly to create an opening for access to the cutout portion 38, and thus facilitating the installation of the head cover 10 around the mounting flange 18. Overlapping ends 44, 46 of the first 40 and second 42 partially overlapping flap portions, respectively, preferably include a fastening mechanism such as mating hook and loop material, for example, material manufactured under the trademark VELCRO, sewn or otherwise secured to the overlapping ends. A number of other equivalent fasteners, including buttons, zippers and the like, are contemplated for the first and second partially overlapping sections 40, 42.

Figure 5:
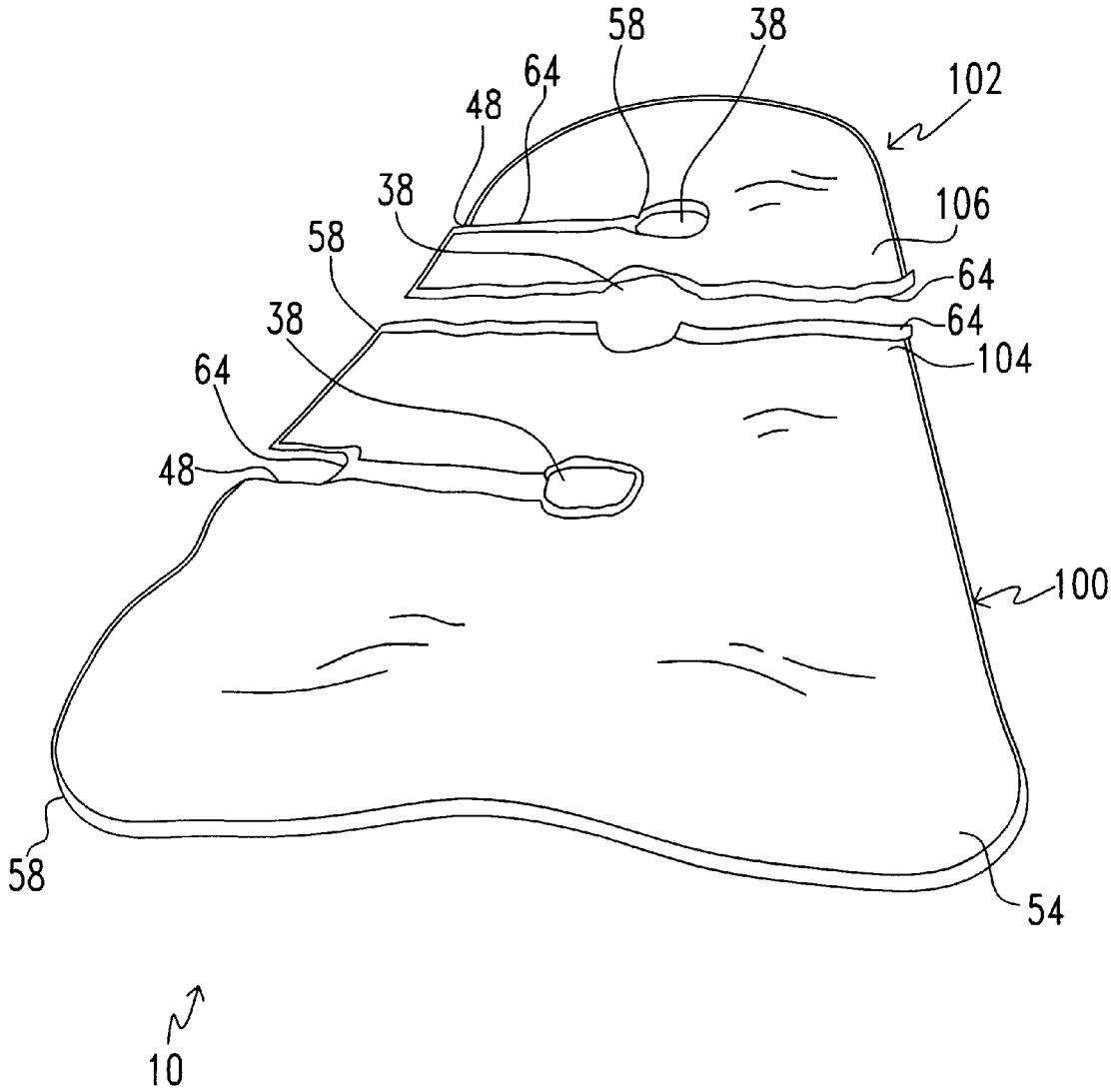
FIG. 5 is a perspective view of an alternate type of embodiment of the head cover having two separate and removably attachable sections.

The head cover 10 may be formed as one integral piece, so that the risk of accidental detachment or misplacement of a segment of the head cover is reduced. Alternatively, the head cover 10 may be formed from two or more separate but removably attachable, partially overlapping sections 100, 102, as shown in FIG. 5, which may connected by overlapping and attaching a pair of respective ends 104, 106, which may connect similarly to the partially overlapping flap portions 40, 42, or in other ways.

In the preferred embodiment, the head cover 10 contains a number of openings, such as slots 48 (best seen in FIGS. 3 and 5), for accommodating one or more steam inlet conduits 22, which may be introduced at various positions along the head 12. The slots 48 preferably allow opening or closing with fasteners such as VELCRO hook and loop fasteners, to fasten around the steam inlet conduits 22.

Figure 4:
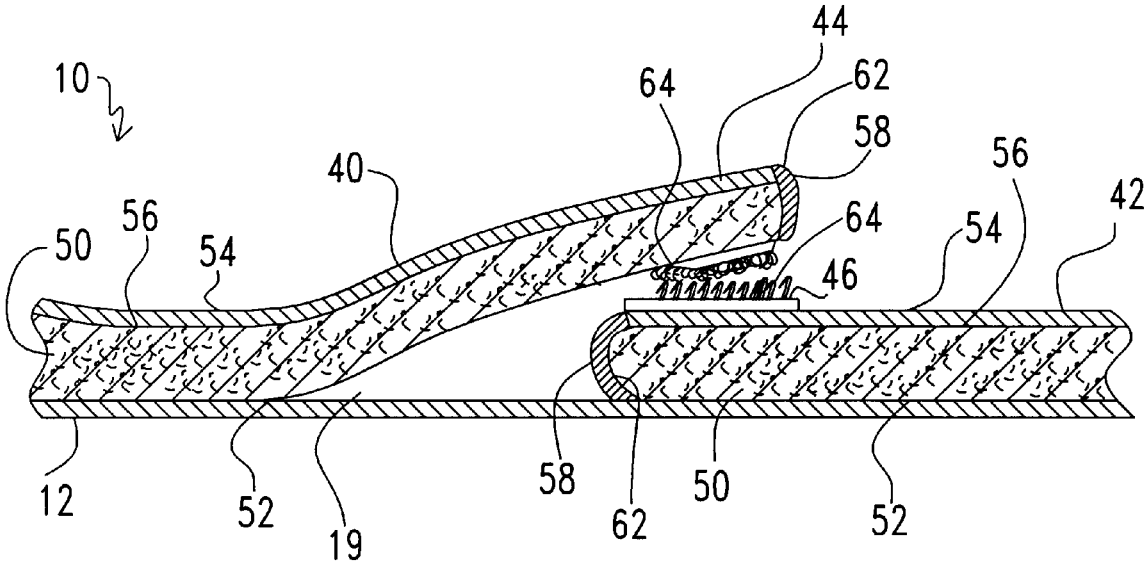
FIG. 4 is a cutaway and enlarged partial view of partially overlapping sections of the head cover detached from one another and positioned over a portion of an upper surface of the head.

FIG. 4 shows the first and second partially overlapping portions 40, 42 of the head cover 10 detached from one another and positioned over the upper surface 19 of the head 12. FIG. 4 also shows preferable component materials of the head cover 10, whether the cover is embodied in a single piece, or composed of two or more sections, such as sections 100 and 102 (shown in FIG. 5). The head cover 10 includes an inner layer 50 of heat-resistant felt fabric, such as NOMEX, having a first or inner surface 52 for directly and preferably contiguously contacting the upper surface 19 of the head 12. It is preferred that the inner layer 50 cover as much of the entire upper surface 19 as possible for reducing heat loss. However, it is also contemplated that only areas of the head 12 are covered that are likely to come in contact with press operators.

An outer fabric layer or covering 54, such as a heat-resistant flannel, preferably manufactured of NOMEX, is disposed above and preferably contacts a second or upper surface 56 of the inner layer 50. The inner layer 50 and the outer layer 54 are preferably different in construction and properties. The inner layer 50 is preferably a fluffy insulation, while the outer layer 54 is preferably an outer fabric "skin" for the inner layer. A suitable combination of NOMEX fabric and NOMEX flannel is manufactured under the trademark FLAMONEL, owned by Resillo Press Pad Company, of Chicago, Ill.

It is contemplated that the inner layer 50 and/or the outer fabric covering 54 may be coated with TEFLON, and are at least partially secured to one another, preferably by being stitched together to form a border seam 58 disposed along the boundary of the head cover 10 (at corresponding boundaries of the inner layer and outer fabric covering), including an outer periphery 60 of the head cover as well as an inner boundary 62 of the first and second partially overlapping portions 40, 42 and the slots 48. Other types of attachments are contemplated, including adhesives or releasable fasteners such as buttons, zippers, VELCRO, etc. The head cover 10 is preferably elongated to fit most heads 12, but may be dimensioned to accommodate various designs of heads, mounting flanges 18, or steam inlet conduits 22. It will be appreciated that the particular positioning, number, and/or dimensioning of the cutout portion 38 (or portions), slots 48, and the first and second partially overlapping portions 40, 42 may be easily changed by varying a forming pattern for the head cover 10 to adapt to various types of garment press apparatuses. The border seam 58 around the outer periphery 60 of the head cover 10 preferably is configured to be tucked underneath the lip 28 of the grid plate. Mating VELCRO fasteners 64 are secured, and preferably sewn, to detachable portions of the head cover 10, such as the overlapping ends 44, 46 or portions of the slots 48. The multiple-piece type of embodiment shown by example in FIG. 5 may further include the mating VELCRO fasteners 64 secured to the pair of overlapping ends 106, 108 for removably attaching the separate sections after they are placed on the head 12.

In one method of installing the head cover 10, with the grid plate in place and the spring fasteners 36 initially disconnected, the overlapping portions of the slots 48 are detached and opened and the first and second partially overlapping sections 40, 42 are detached and separated. The head cover 10 may then be placed on the head 12 so that first and second partially overlapping sections 40, 42 are pulled around the mounting flange 18 of the support mechanism 16, allowing the mounting flange to project through the cutout portion 38. Once placed around the mounting flange 18, the first and second overlapping ends 44, 46 are fastened together to close the cutout portion 38 around the mounting flange. The border seam 58 on the outer periphery of the head cover 10 is tucked underneath the lip 28. Preferably, once the head cover 10 is situated, the spring fasteners 36, attached to portions of the lip 28, are connected, securing both the grid plate and the head cover. With the insulating head cover 10 in place, the garment press apparatus 14 may be operated in a typical manner.

With the multiple-piece type of embodiment of the head cover 10 shown by example in FIG. 5, the first and second separate sections 100, 102 are separately placed over the head 12, and the sections are attached to one another, preferably at the overlapping ends 106, 108 via the mating fastener 64. The cutout portions 38 and the slots 48 may be fitted around the mounting flange 18 and the steam inlet conduit 22 or conduits, respectively. The multiple-piece type of embodiment may allow an easier install of the head cover 10 over the head 12.

The inventive construction of the present head cover 10 allows it to be inherently flexible and to naturally conform to the non-pressing upper surface 34 of the head 12. In this way, the head cover 10 is held securely in place by the lip 28 and the spring fasteners 36, without additional parts being required. The flexibility of the head cover 10 also allows a close fit upon the different shapes and sizes of heads 12, such as the alternate shape shown in FIG. 3, without requiring rigid, contour forming metal plates.

The inner layer 50, in combination with the outer fabric covering 54 insulates the head 12, which substantially reduces heat loss from the head, and lowers the surface temperature exposed to the operator typically to approximately 100° F. to 140° F. This conserves energy required to heat the head 12, and also allows the skin of an operator to contact the head 12 via the cover 10 without the risk of burn injury or discomfort. Because of the small number of components needed to form the head cover 10, and the ease of manufacturing, the head cover is significantly less expensive to manufacture than prior art devices.

Because of the flexibility of the head cover 10, it may be easily transported by, for example, rolling, folding or otherwise compacting the cover. The head cover 10 when rolled, for example, may be stored within a tube or other container for convenient transport.

While various embodiments of the present improved head cover have been shown and described, it should be understood that other modifications, substitutions and alternatives may be apparent to one of ordinary skill in the art. Such modifications and alternatives can be made without departing from the spirit and scope of the invention which should be determined from the appended claims.

What is claimed is:

1. A thermally insulative cover for covering a non-pressing upper surface of a head of a garment press apparatus, the cover comprising:

an inner layer of heat-resistant material having a first surface configured to directly contact the upper surface and a second surface opposite said first surface; and an outer fabric covering of heat-resistant material secured to said inner layer and covering said second surface of said inner layer;

wherein said cover is configured to conform to the upper surface of the head to at least partially insulate the head from heat loss, said inner layer comprises a heat-resistant, insulative synthetic felt, and said outer fabric covering comprises a heat-resistant, synthetic fiber flannel.

2. The cover of claim 1 wherein said outer fabric covering directly covers said second surface of the inner layer.

3. The cover of claim 2 wherein said inner layer is stitched to said outer fabric along corresponding boundaries of said inner layer and said outer fabric.

4. The cover of claim 3 wherein the head is fitted with a grid plate having a lip extending about a periphery of the upper surface of the head, and wherein a stitched outer periphery of the cover is configured to be tucked between the lip and the upper surface of the head.

5. The cover of claim 3 wherein the cover is a single piece.

6. The cover of claim 3 wherein the cover includes a plurality of removably attachable sections.

7. The cover of claim 1 further comprising a cutout portion to accommodate a mounting flange of a support mechanism attached to the head.

8. The cover of claim 7 further comprising first and second portions, which are removably attachable for opening and closing the cover around the cutout portion so that said cover can be fitted around the mounting flange of the support mechanism.

9. The cover of claim 1 wherein the garment pressing apparatus includes a steam inlet conduit connected to the head, and wherein said cover further comprises at least one slot for accommodating a portion of said steam inlet conduit.

10. A thermally insulative cover system for a head of a garment press apparatus, the head being attached to a mounting flange of a support mechanism for supporting the head, the garment press apparatus including at least one steam inlet conduit for supplying steam to an interior of the head, the head having a non-pressing upper surface and a grid plate underneath the head, the cover system comprising:

a lip configured to be secured to a periphery of the grid plate and to extend partially over the upper surface of the head;

an inner layer of heat-resistant felt material having a first surface configured to directly and contiguously cover the upper surface of the head and a second surface opposite said first surface;

a heat-resistant fabric covering secured to and covering said second surface of said inner layer so that said inner layer and said fabric covering form at least one cover section having a boundary;

a border seam stitching the inner layer to the fabric covering about the boundary of the cover, the border seam being configured to be disposed between the lip and the upper surface of the head; and a fastener disposed over the cover and attached to the lip for securing the grid plate;

whereby both the grid plate and the cover are held in position by said fastener.

11. The cover system of claim 10 wherein the cover further comprises a cutout portion for accommodating the mounting flange of the support mechanism, the cutout portion having a segment that is removably attachable, wherein the cover can be fitted around the mounting flange of the support mechanism.

12. A thermally insulative cover for covering a non-pressing upper surface of a head of a garment press apparatus, the cover comprising:

an inner layer of heat-resistant felt material having a first surface configured to directly contact the upper surface without any interim support layers and a second surface opposite said first surface;

an outer fabric covering of heat-resistant material secured to said inner layer and covering said second surface of said inner layer; and wherein said cover is configured to conform to the upper surface of the head without internal stiffening material to at least partially insulate the head from heat loss.

* * * * *